US010039425B2

(12) United States Patent
Azelton et al.

(10) Patent No.: US 10,039,425 B2
(45) Date of Patent: Aug. 7, 2018

(54) DISINFECTING WIPES DISPENSER

(71) Applicant: THE CLOROX COMPANY, Oakland, CA (US)

(72) Inventors: Kerry D. Azelton, Pleasanton, CA (US); Russell E. Bell, Pleasanton, CA (US); Jon Markey, Greensboro, NC (US); Joshua Glessner, High Point, NC (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 15/336,548

(22) Filed: Oct. 27, 2016

(65) Prior Publication Data

US 2017/0042395 A1 Feb. 16, 2017

Related U.S. Application Data

(63) Continuation-in-part of application No. 14/684,842, filed on Apr. 13, 2015.

(Continued)

(51) Int. Cl.
*B65H 1/00* (2006.01)
*A47K 10/42* (2006.01)

(Continued)

(52) U.S. Cl.
CPC .... *A47K 10/421* (2013.01); *A47K 2010/3233* (2013.01); *A47K 2010/3266* (2013.01);

(Continued)

(58) Field of Classification Search
CPC ..... A47K 10/421; A47K 2010/3266; A47K 2010/3233; B65D 43/02; B65D 53/00; B65D 85/62

(Continued)

(56) References Cited

U.S. PATENT DOCUMENTS 3,092,439 A * 6/1963 Harrison ..... B26F 1/00 156/84
3,749,296 A 7/1973 Harrison (Continued)

FOREIGN PATENT DOCUMENTS

CN 203889189 10/2014
EP 0179498 B1 7/1989

(Continued)

OTHER PUBLICATIONS

PCT Search Report dated Jul. 16, 2015, International Application No. PCT/US15/25757.

(Continued)

*Primary Examiner* — Rakesh Kumar
(74) *Attorney, Agent, or Firm* — Erin Collins

(57) ABSTRACT

Wipes dispensers for dispensing interconnected wipes. An exemplary wipes dispenser may include a container body and a removable lid forming an interior region into which a plurality of interconnected wipes may be disposed. Pulling on a lead end of a lead wipe causes a following wipe to also be pulled and follow the lead wipe. The removable lid may cover at least a portion of the container aperture. A landing member in the lid covers at least a portion of the container aperture by extending from a top rim of the container body toward the middle of the interior region. A gripping channel may be provided through the landing member, through which the lead end of the lead wipe may be threaded. The landing member may include a concavely shaped portion. The landing member may include a thickened portion, e.g., surrounding the gripping channel.

4 Claims, 19 Drawing Sheets

Related U.S. Application Data

(60) Provisional application No. 61/983,408, filed on Apr. 23, 2014.

(51) Int. Cl.
*A47K 10/32* (2006.01)
*B65D 53/00* (2006.01)
*B65D 85/62* (2006.01)
*B65D 43/02* (2006.01)

(52) U.S. Cl.
CPC ..... *B65D 43/02* (2013.01); *B65D 53/00* (2013.01); *B65D 85/62* (2013.01)

(58) Field of Classification Search
USPC ..... 221/38, 63
See application file for complete search history.

(56) References Cited

U.S. PATENT DOCUMENTS 3,868,052 A 2/1975 Rockefeller
4,262,816 A 4/1981 Margulies
4,289,262 A 9/1981 Finkelstein
4,387,819 A 6/1983 Corsette
4,462,507 A 7/1984 Margulies
D354,225 S 1/1985 Norton et al.
4,496,066 A 1/1985 Bullock, III
4,526,291 A 7/1985 Margulies
4,682,700 A 7/1987 Montgomery et al.
4,815,620 A 3/1989 Bullock, III
D354,224 S 1/1995 Norton et al.
5,516,001 A 5/1996 Muckenfuhs et al.
5,699,912 A * 12/1997 Ishikawa ..... A47K 10/421 206/494
5,730,309 A 3/1998 Jiradejnunt et al.
6,082,567 A 7/2000 Bietzer et al.
6,158,614 A 12/2000 Haines et al.
D443,450 S 6/2001 Ruhotas et al.
D449,528 S 10/2001 Buck et al.
6,394,298 B1 * 5/2002 Zaidnnan ..... A47K 10/421 206/494
6,409,044 B1 6/2002 Brown et al.
D466,807 S 12/2002 Buck et al.
6,536,616 B2 3/2003 Sandor et al.
6,554,156 B1 4/2003 Chong
6,581,792 B1 6/2003 Limanjaya
7,090,088 B2 8/2006 von Holdt, Jr.
D531,499 S 11/2006 Zaldman
D531,897 S 11/2006 Evans et al.
7,143,906 B2 12/2006 Chasid
D541,173 S 4/2007 Karussi et al.
7,213,720 B2 5/2007 Giraud
7,216,775 B2 5/2007 Evans et al.
D544,346 S 6/2007 Karussi et al.
7,546,930 B2 6/2009 Banik et al.
7,556,175 B2 7/2009 Simkins
7,703,621 B2 4/2010 Evans et al.
7,731,057 B2 6/2010 Evans et al.
7,806,292 B2 10/2010 Simkins
7,922,036 B2 4/2011 Bendor et al.
7,988,008 B2 8/2011 Banik et al.
8,104,657 B2 1/2012 Barella
8,297,461 B2 10/2012 Evans
8,308,008 B2 11/2012 Perry et al.
8,944,279 B2 * 2/2015 Shoaf ..... A47K 10/421 206/204
9,498,091 B2 * 11/2016 Yamada ..... B65D 75/5894
2003/0080018 A1 5/2003 Nally
2004/0011813 A1 1/2004 Kasting et al.
2004/0099681 A1 5/2004 Julius
2006/0191933 A1 8/2006 Hicks
2007/0215632 A1 9/2007 Bendor et al.
2008/0035663 A1 2/2008 Byl et al.
2008/0110920 A1 5/2008 Hlista et al.
2009/0114669 A1 5/2009 Decker et al.
2009/0194554 A1 8/2009 Bliss et al.
2009/0289077 A1 11/2009 Melin et al.
2009/0314793 A1 * 12/2009 Reedy ..... B60R 7/084 221/45
2010/0078443 A1 * 4/2010 Hoefing ..... A47K 10/3818 221/45
2010/0108706 A1 5/2010 Oman
2010/0133287 A1 6/2010 Tramontina et al.
2010/0206896 A1 8/2010 Raw Ew et al.
2010/0270326 A1 10/2010 Wong et al.
2011/0139807 A1 6/2011 Ray et al.
2012/0017766 A1 1/2012 Anson et al.
2012/0118905 A1 5/2012 Lindbergh
2012/0145737 A1 6/2012 Ray et al.
2013/0008919 A1 1/2013 Honan et al.
2013/0153597 A1 6/2013 Hill et al.
2013/0240556 A1 * 9/2013 Yamada ..... B65D 75/5894 221/63
2014/0021219 A1 1/2014 Honan
2014/0158687 A1 6/2014 Honan et al.
2014/0190983 A1 * 7/2014 Sanguinet ..... A47K 10/3818 221/63
2014/0291343 A1 10/2014 Neitzel
2014/0367400 A1 * 12/2014 Crudge ..... A47K 10/3818 221/1
2015/0069081 A1 3/2015 Fujimoto
2015/0164290 A1 6/2015 Leung et al.
2015/0305579 A1 * 10/2015 Azelton ..... A47K 10/42 221/63

FOREIGN PATENT DOCUMENTS

EP 1851127 B1 7/2007
GB 2335624 9/1999
WO WO9819946 A1 5/1998
WO WO2006093579 A1 9/2006
WO WO2007105182 A1 9/2007
WO WO-2008110770 A1 * 9/2008 ..... A47K 10/3818
WO WO2008110770 A1 9/2008
WO WO-2013076467 A2 * 5/2013 ..... A47K 10/3818
WO WO2013076467 A2 5/2013
WO WO-2013189511 A1 * 12/2013 ..... B65D 83/0805
WO WO2013189511 A1 12/2013

OTHER PUBLICATIONS

Non Final Office Action dated Jul. 14, 2016, U.S. Appl. No. 14/684,842, filed Apr. 13, 2015.
Final Office Action dated Jan. 12, 2017, U.S. Appl. No. 14/684,842, filed Apr. 13, 2015.

* cited by examiner

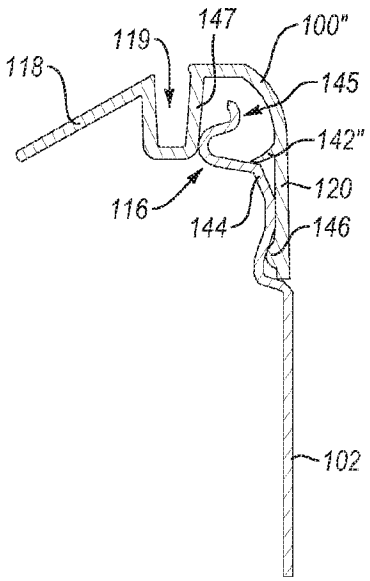
FIG. 4E
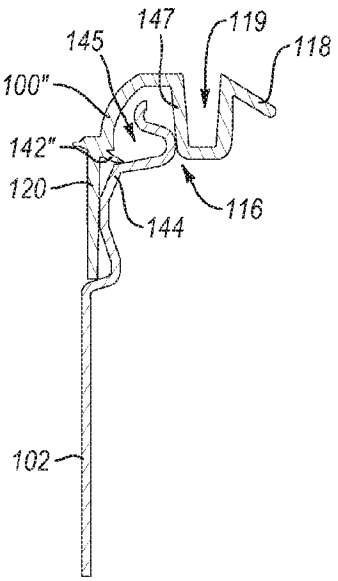

DISINFECTING WIPES DISPENSER

CROSS-REFERENCE TO RELATED APPLICATIONS

The present application is a continuation-in-part of U.S. patent application Ser. No. 14/684,842 filed Apr. 13, 2015, which claims the benefit of U.S. Provisional Patent Application No. 61/983,408 filed Apr. 23, 2014. The present application is also a continuation-in-part of U.S. Design patent application Ser. No. 29/546,527 filed Nov. 23, 2015. The disclosure of each of the above referenced applications is incorporated herein in its entirety.

BACKGROUND OF THE INVENTION

1. The Field of the Invention

The present invention relates to containers including a removable lid, such as those used in the dispensing of wipes used in disinfection, cleaning, etc.

2. Description of Related Art

Wetted wipes including a cleaning formulation impregnated therein are employed in a wide variety of circumstances for disinfecting or cleaning various surfaces. Because the wipes are pre-wetted with a cleaning formulation, it is important that the container be sealed so as to prevent the wipes from prematurely drying out.

Such wipes may initially be attached to one another, with a line of perforations, rouletting, or similar mechanism by which they may in theory be easily separated from one another, as a lead wipe may be torn from the following wipe as it is pulled from the container. In actual practice, with existing dispensing configurations, there is a tendency for the lead wipe to not fully separate from the following wipe as the lead wipe is pulled from the dispenser (referred to as "roping"), leading to more than the single desired wipe being dispensed. Such roping leads to waste, as more wipes than the user intended end up being dispensed from the container.

Another issue with existing configurations is the tendency for the lead wipe to fall back into the container, requiring the user to retrieve the lead wipe and rethread it into the retention mechanism. As a result, there continues to be a need for improved wipe dispenser configurations that may alleviate one or more of these issues.

BRIEF SUMMARY OF THE INVENTION

In an embodiment, the present invention is directed to a wipes dispenser comprising a container including a container body and a removable lid forming an interior region containing a plurality of wipes that are interconnected such that pulling on a lead wipe of the plurality of wipes causes a following wipe of said plurality of wipes to also be pulled and follow the lead wipe. The wipes dispenser also includes a container aperture defined through an exterior wall of the container (e.g., over which the removable lid may be disposed). The removable lid may further include a rigid landing member that covers a portion of the container aperture by extending from a top rim of the container body toward the middle of the interior region of the container. The landing member may form an angle with a substantially vertical exterior wall of the container that is less than 90°. For example, the landing member may be angled downward, towards the bottom of the interior region of the container, or the landing member may include a concave, downwardly curved surface, which similarly forms an angle with the substantially vertical exterior wall of the container that is less than 90°. The landing member may further include a gripping channel therein that communicates with the interior of the container through the container aperture, wherein the plurality of wipes are removed from the container by being pulled through the gripping channel, the gripping channel separating a lead wipe from a following wipe as the lead wipe is pulled through the gripping channel. The landing member may further include a secondary aperture which allows a user to reach into the container, grab a lead wipe, and thread the lead wipe through the gripping channel.

Such configurations aid in reducing the tendency of the wipes to "rope", particularly where the wipes are pulled from the container in a substantially vertical direction, which consumers are prone to do. Such configurations allow a user to quickly pull the lead wipe through the gripping channel, separating it from the following wipe as it is pulled through the gripping channel. The inclusion of the secondary aperture advantageously allows the user to reach through the secondary aperture of the removable lid and grab a lead wipe if the lead wipe is not already threaded within the gripping channel, without the user's fingers being uncomfortably scraped by surfaces adjacent the secondary aperture.

Another embodiment of the present invention is directed to a wipes dispenser including a container having a container body and a removable lid forming an interior region containing a plurality of wipes that are interconnected such that pulling on a lead end of a lead wipe of the plurality of wipes causes a following wipe of the plurality of wipes to also be pulled and follow the lead wipe. The wipes dispenser further includes a container aperture defined through an exterior wall of the container. The removable lid may include a rigid landing member that covers a portion of the container aperture by extending from a top rim of the container body toward the middle of the interior region of the container creating a concave portion of the landing member. The landing member may further include one or more fingers, and a gripping channel communicating with the interior of the container through the container aperture wherein the plurality of wipes are removed from the container by being pulled through the gripping channel, the gripping channel separating a lead wipe from a following wipe as the lead wipe is pulled through the gripping channel. The landing member further includes a secondary aperture therethrough which allows a user to reach into the container and grab and thread a lead wipe through the gripping channel.

Another embodiment is directed to a wipes dispenser comprising a container including a container body and a removable lid. The container body and removable lid form an interior region containing a plurality of wipes that are interconnected such that pulling on a lead end of a lead wipe of the plurality of wipes causes a following wipe of the plurality of wipes to also be pulled and follow the lead wipe. A container aperture is defined through an exterior wall of the container which may be partially covered by the removable lid. The removable lid includes a crab claw sealing member which bends as it contacts a side rim of the container body when the lid is secured to the container body. The lid further includes a rigid landing member which covers a portion of the container aperture by extending from a top rim of the container body towards the middle of the interior region of the container. The landing member comprises one or more fingers. A gripping channel in the landing member communicates with the interior of the container through the container aperture, and the plurality of wipes are removed from the container by being pulled through the gripping channel, the gripping channel separating a lead wipe from a following wipe as the lead wipe is pulled through the gripping channel. The landing member may further include a secondary aperture which allows a user to reach into the container and grab a lead wipe and thread it through the gripping channel.

Another embodiment of the present invention is directed to a wipes dispenser comprising a container including a container body and a removable lid forming an interior region containing a plurality of wipes that are interconnected such that pulling on a lead wipe of the plurality of wipes causes a following wipe of said plurality of wipes to also be pulled and follow the lead wipe. The wipes dispenser also includes a container aperture defined through an exterior wall of the container (e.g., over which the removable lid may be disposed). The removable lid may further include a rigid landing member that covers at least a portion of the container aperture by extending from a top rim of the container body toward the middle of the interior region of the container. The landing member may form an angle with a substantially vertical exterior wall of the container that is less than 90°. For example, the landing member may be angled or curved downward, towards the bottom of the interior region of the container. The landing member may further include a gripping channel formed therein that communicates with the interior of the container through the container aperture, wherein the plurality of wipes are removed from the container by being pulled through the gripping channel, the gripping channel separating a lead wipe from a following wipe as the lead wipe is pulled through the gripping channel. The landing member may further include a thickened strip or other region of material extending across at least a portion of the landing member, and surrounding at least a portion of the gripping channel. The thickened region of material may be thicker than adjacent portions of the landing member.

Another embodiment of the present invention is directed to a wipes dispenser including a container having a container body and a removable lid forming an interior region containing a plurality of wipes that are interconnected such that pulling on a lead end of a lead wipe of the plurality of wipes causes a following wipe of the plurality of wipes to also be pulled and follow the lead wipe. The wipes dispenser further includes a container aperture defined through an exterior wall of the container. The removable lid may include a rigid landing member that covers a portion of the container aperture by extending from a top rim of the container body toward the middle of the interior region of the container creating a concave portion of the landing member. The landing member may cover a majority of the container aperture, and a gripping channel may extend through the landing member, communicating with the interior of the container through which the plurality of wipes are removed by being pulled through the gripping channel. The gripping channel separates a lead wipe from a following wipe as the lead wipe is pulled through the gripping channel. The landing member may further include a thickened strip or other region of material extending across at least a portion of the landing member, and surrounding at least a portion of the gripping channel. The thickened region of material may be thicker than adjacent portions of the landing member.

Another embodiment is directed to a wipes dispenser comprising a container including a container body and a removable lid. The container body and removable lid form an interior region containing a plurality of wipes that are interconnected such that pulling on a lead end of a lead wipe of the plurality of wipes causes a following wipe of the plurality of wipes to also be pulled and follow the lead wipe. A container aperture is defined through an exterior wall of the container which may be partially covered by the removable lid. The lid includes a rigid landing member configured such that the lid covers an entirety of the container aperture but for the gripping channel formed through the landing member. The gripping channel in the landing member communicates with the interior of the container through the container aperture, and the plurality of wipes are removed from the container by being pulled through the gripping channel, the gripping channel separating a lead wipe from a following wipe as the lead wipe is pulled through the gripping channel. The landing member may further include a thickened strip or other region of material extending across at least a portion of the landing member, and surrounding at least a portion of the gripping channel. The thickened region of material may be thicker than adjacent portions of the landing member.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which:

FIG. 4E shows another cross-sectional view through a removable lid and container, illustrating another alternative sealing arrangement;

DETAILED DESCRIPTION OF THE PREFERRED EMBODIMENTS

I. Definitions

Figure 1:
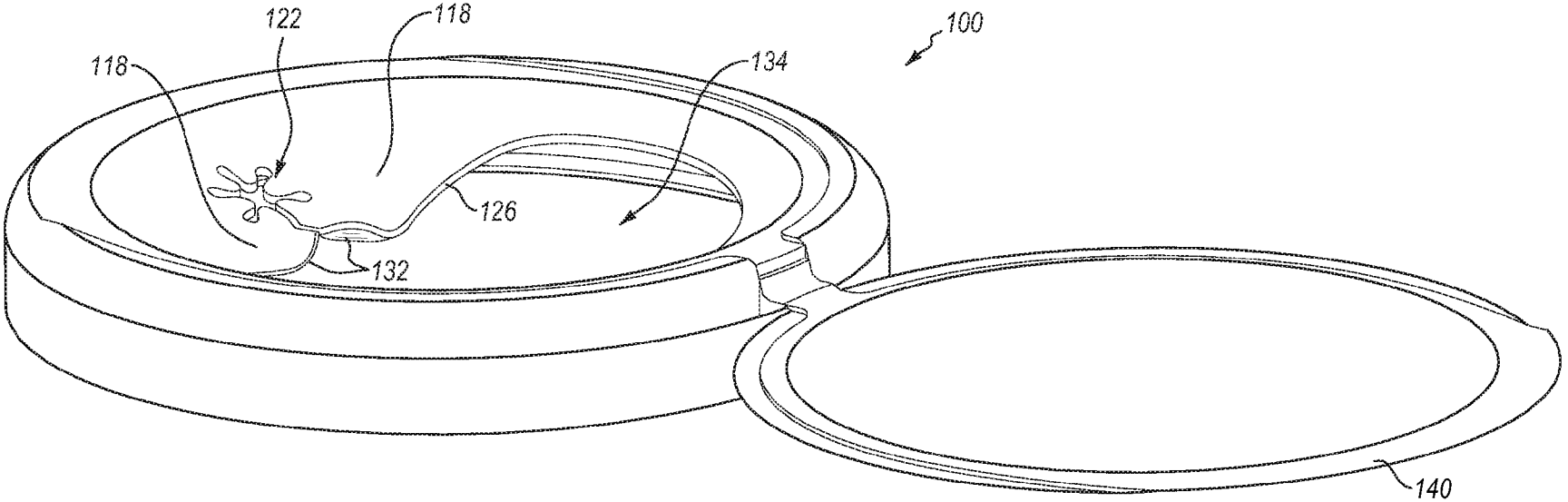
FIG. 1 is a perspective view of an exemplary removable lid including a hinged lid cover that may be used with wipes dispensers according to the present invention.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

The present invention is directed to wipes dispensers from which wipes may be dispensed one at a time as a lead wipe of a plurality of interconnected wipes is pulled from the dispenser, becoming separated from the following wipe as it is dispensed. An exemplary wipes container may include a container body and a removable lid coupleable to the container body. The container body and lid form an interior region into which a plurality of interconnected wipes (e.g., arranged as a "donut") may be disposed, such that pulling on a lead end of a lead wipe causes a following wipe of the plurality of interconnected wipes to also be pulled and follow the lead wipe. The wipes dispenser includes a container aperture (e.g., an open top of a cylindrical container body) defined through an exterior wall of the container. The removable lid may cover a portion of the container aperture. The removable lid may include a rigid landing member that covers a portion of the container aperture by extending from a top rim of the container body toward the middle of the interior region of the container. The landing member may form an angle with a substantially vertical exterior wall of the container, where the formed angle may be less than 90°. In an embodiment, the landing member may include a concavely shaped portion. The landing member may include one or more fingers.

The landing member may include a gripping channel communicating with the interior of the container through the container aperture, wherein the plurality of wipes are removed from the container by being pulled through the gripping channel, the gripping channel separating a lead wipe from a following wipe as the lead wipe is pulled through the gripping channel. A secondary aperture may be provided in the landing member which allows a user to reach into the container and grab a lead wipe and thread the lead wipe through the gripping channel. A crab claw sealing member may be provided on an internal surface of the removable lid, which crab claw sealing member bends as it contacts a side rim of the container body when the removable lid is secured to the container body.

III. Exemplary Wipes Dispensers

Figure 2A:
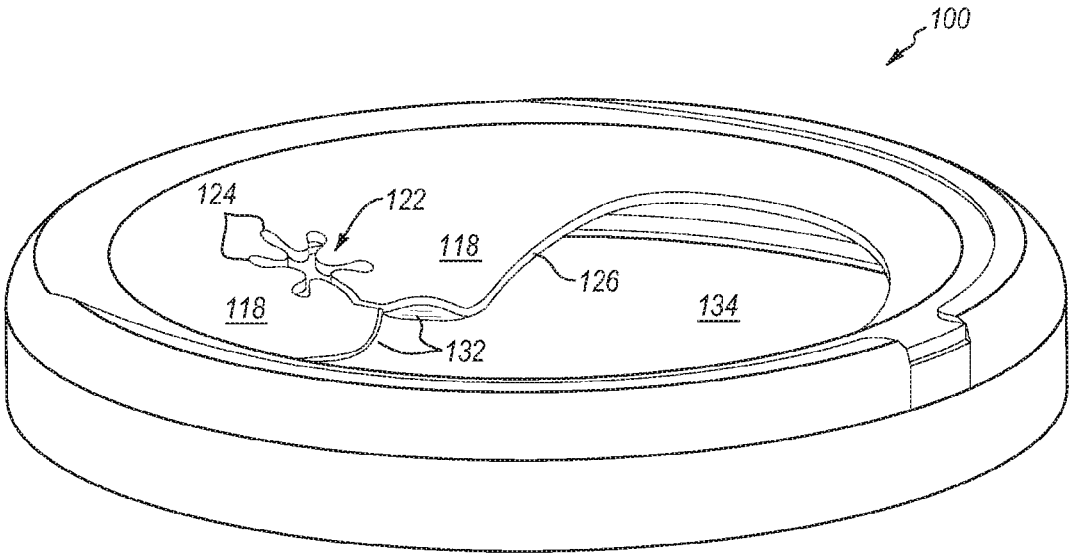
FIG. 2A is a perspective view of the removable lid of FIG. 1, without showing the hinged lid cover for simplicity.
Figure 2B:
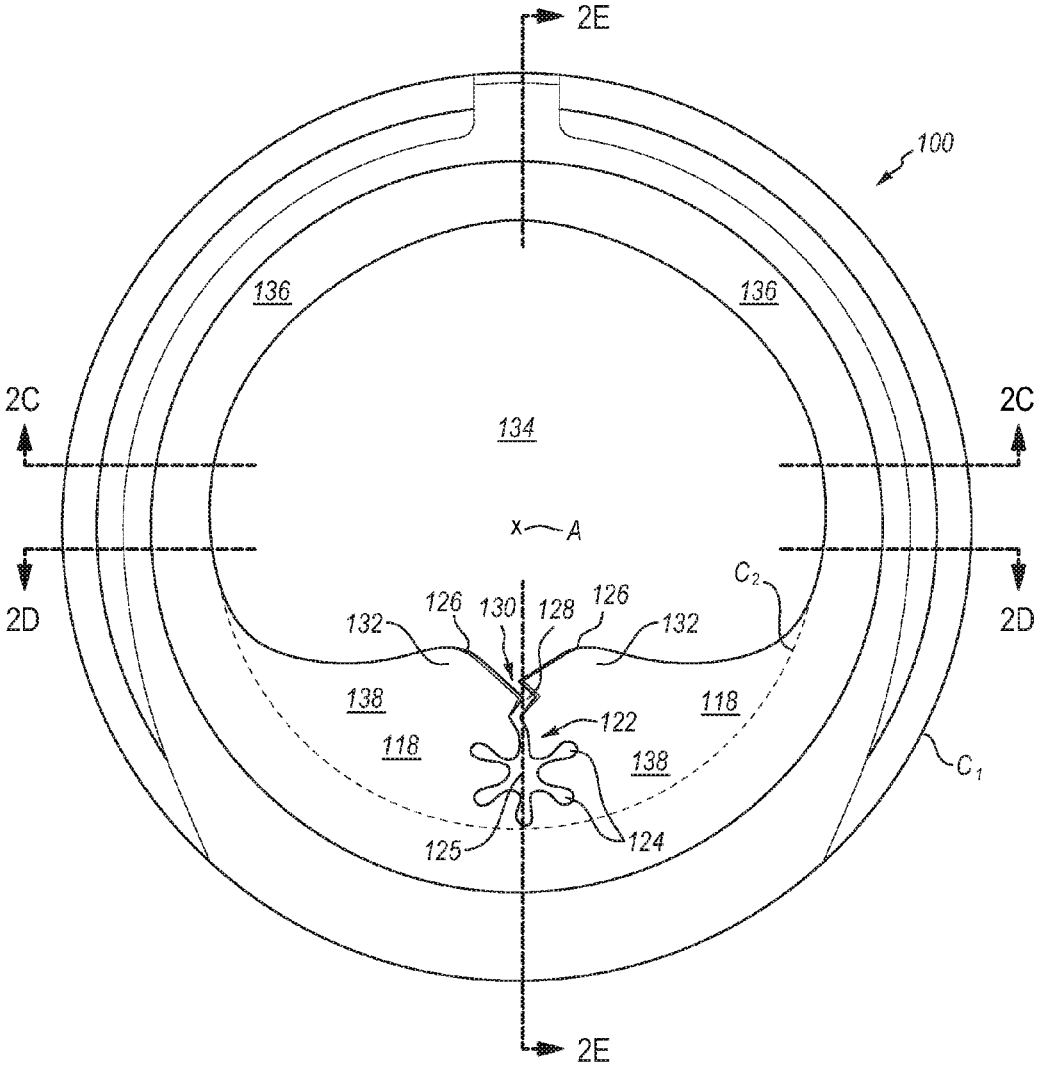
FIG. 2B is a top plan view of the removable lid of FIG. 2A.
Figure 2C:
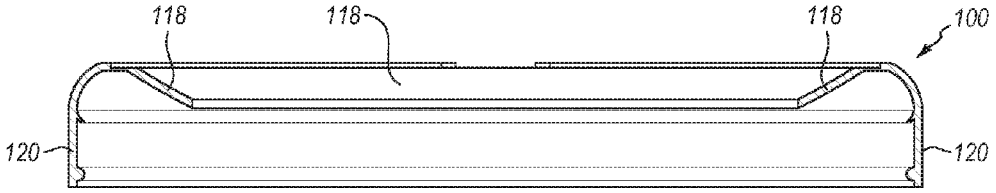
FIG. 2C is a cross-sectional view taken along lines 2C-2C of FIG. 2B.
Figure 2D:
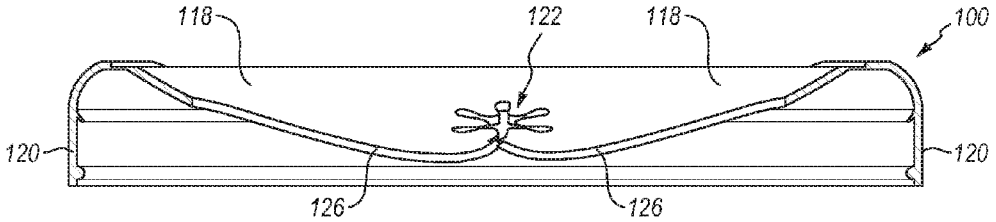
FIG. 2D is a cross-sectional view taken along lines 2D-2D of FIG. 2B.
Figure 2E:
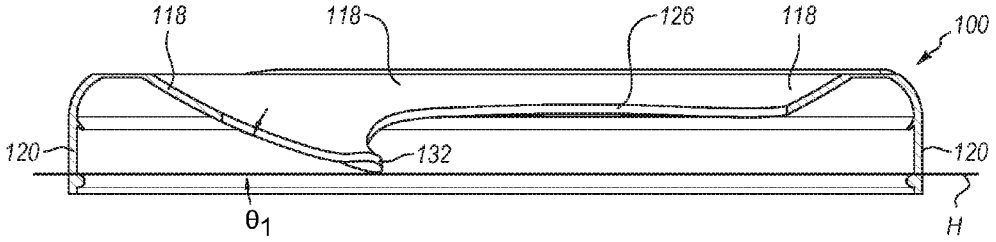
FIG. 2E is a cross-sectional view taken along lines 2E-2E of FIG. 2B.
Figure 3:
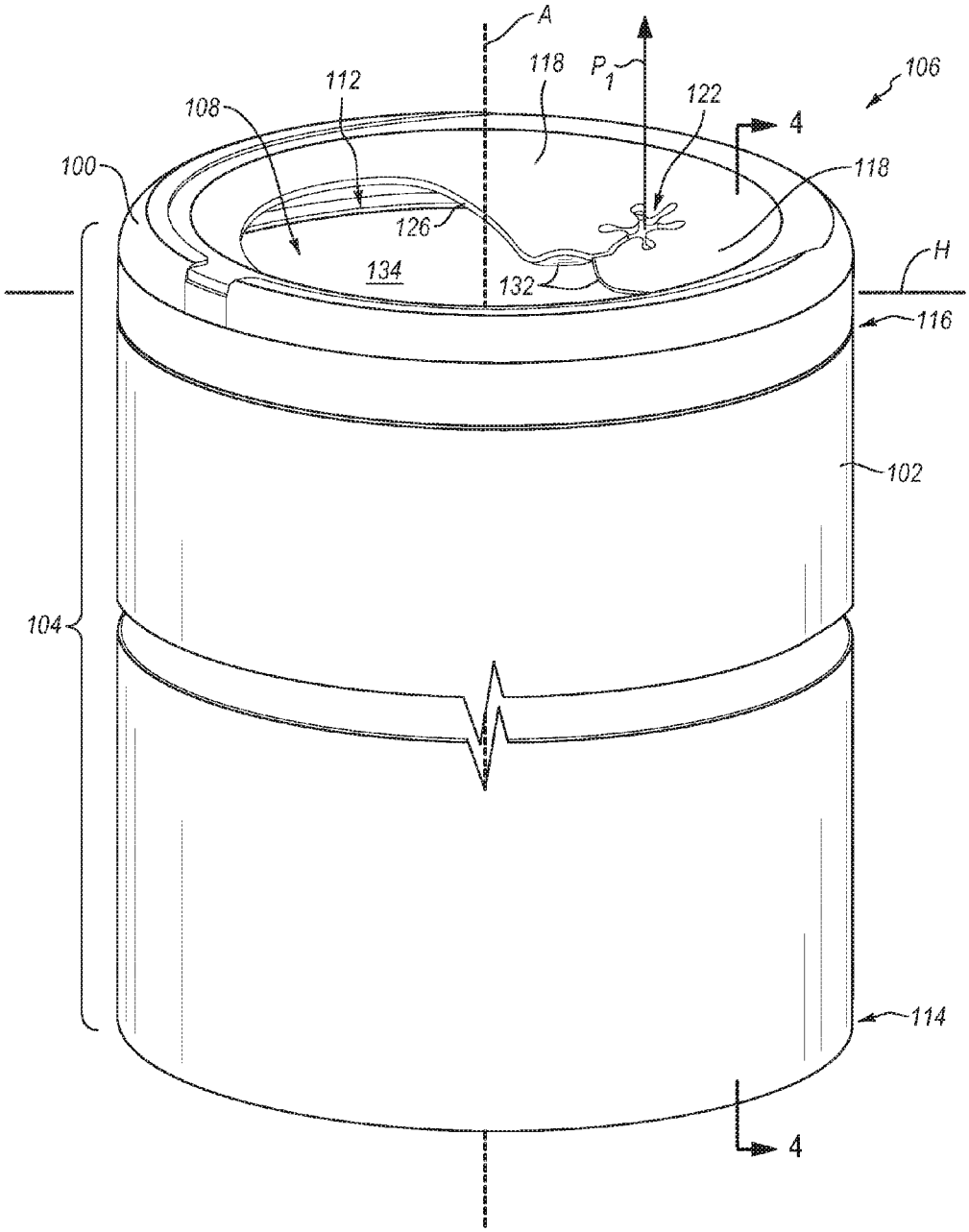
FIG. 3 is a perspective view of an exemplary wipes dispenser including the removable lid of FIG. 2A coupled over an exemplary container body.
Figure 5:
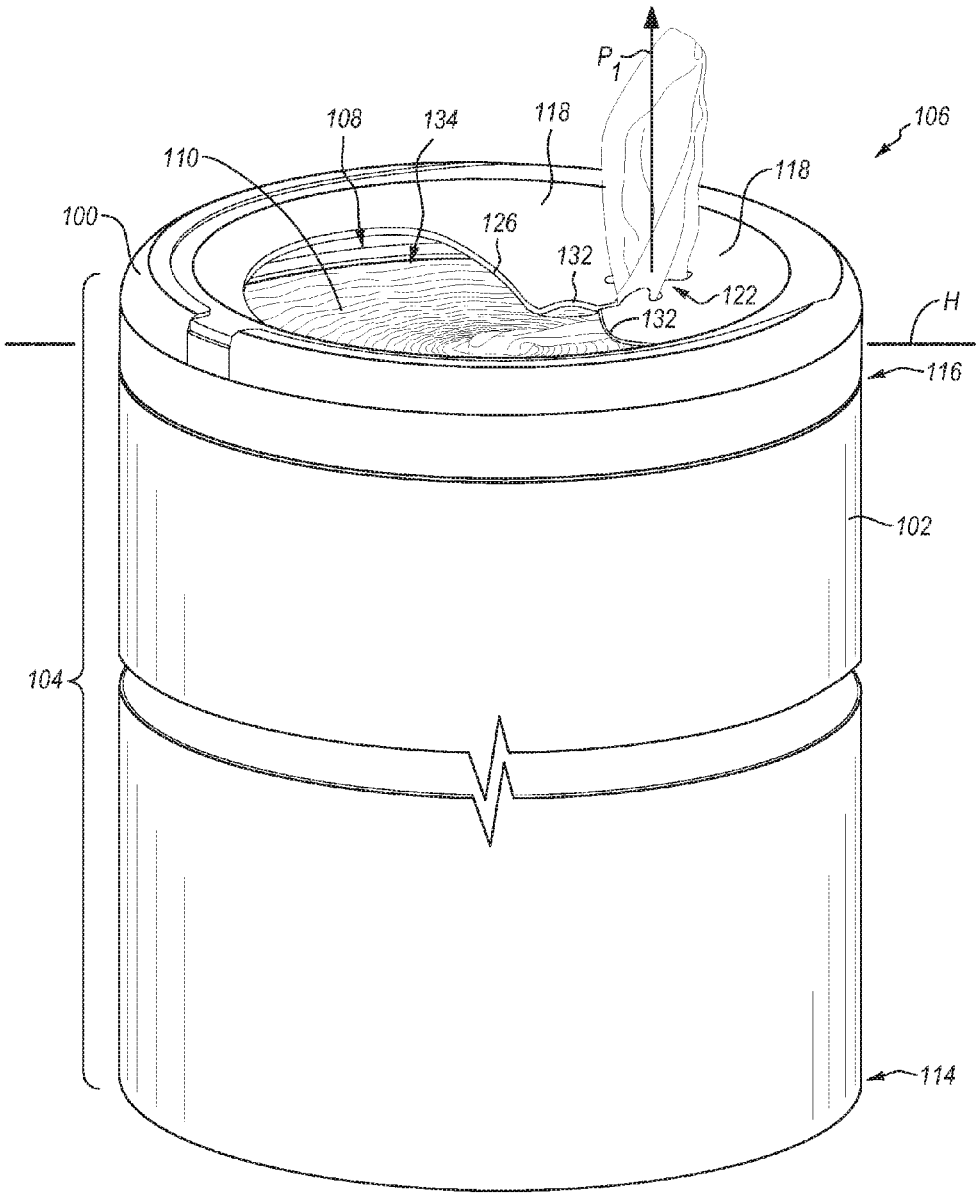
FIG. 5 is a perspective view of an exemplary wipes dispenser similar to that of FIG. 3, but shown with a wipe threaded in the gripping channel ready to be dispensed.
Figure 5A:
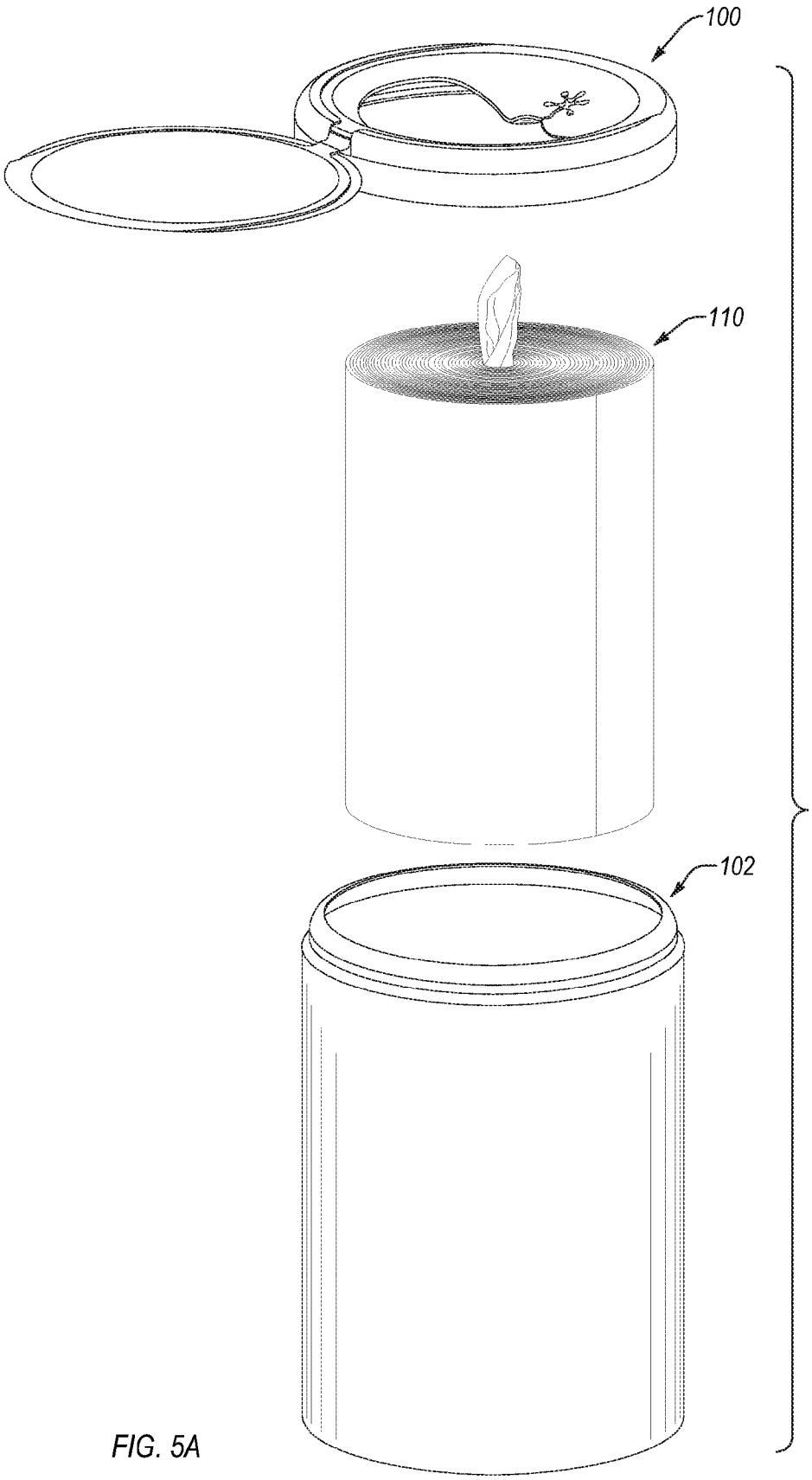
FIG. 5A is an exploded view of the exemplary wipes dispenser of FIG. 5.
Figure 6A:
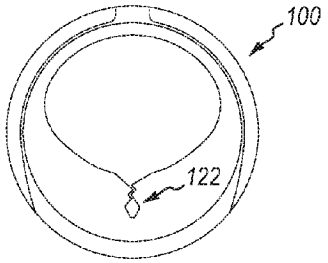
FIGS. 6A-6M are top plan views showing removable lids similar to that of FIG. 2B, but each with an alternatively configured gripping channel.
Figure 6B:
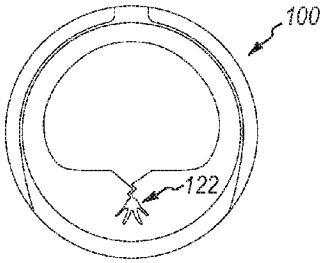
Figure 6C:
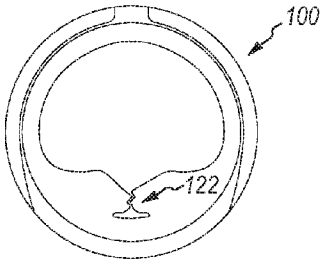
Figure 6D:
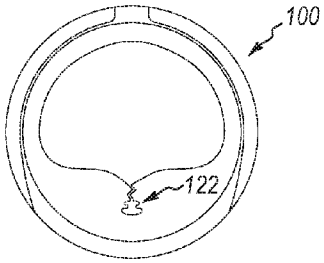
Figure 6E:
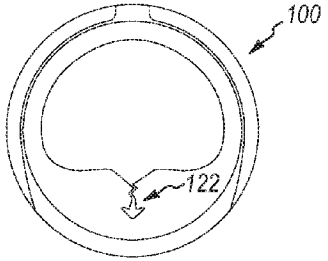
Figure 6F:
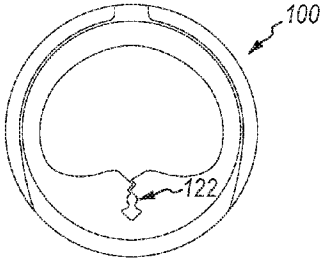
Figure 6G:
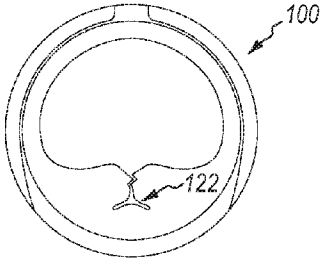
Figure 6H:
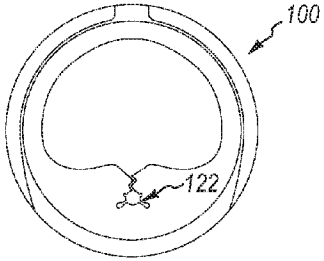
Figure 6I:
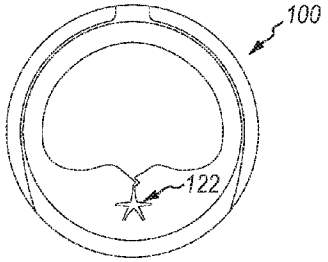
Figure 6J:
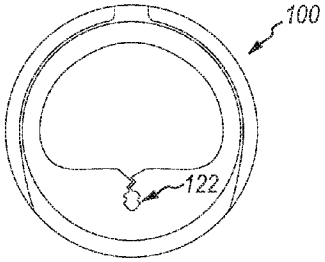
Figure 6K:
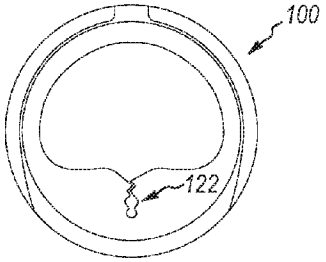
Figure 6M:
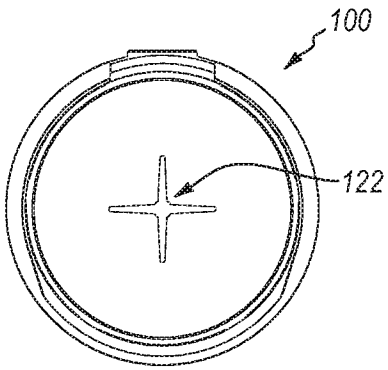
Figure 6L:
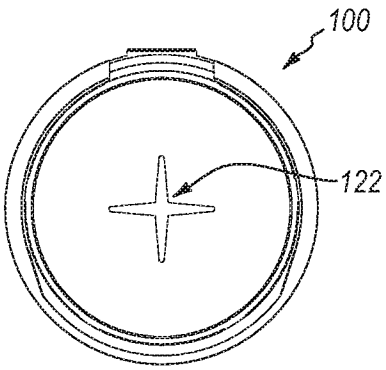

FIGS. 1-3 illustrate an exemplary removable lid 100 for use with a container body 102 so as to form a container 104 that may form a portion of a wipes dispenser 106 according to the present invention. FIGS. 1-2E illustrate various views of removable lid 100. As shown in FIG. 1, removable lid 100 may include a hinged cover 140, which closes over landing member 118 and secondary aperture 134. Hinged cover 140 is not shown in the remaining Figures for the sake of simplicity. FIG. 3 shows a perspective view of exemplary wipes dispenser 106, including container 104 that is formed by removable lid 100 and container body 102. Container body 102 and removable lid 100 of wipes dispenser 106 form an interior region 108, e.g., within hollow container body 102, capped by removable lid 100 (see FIG. 3). As shown in FIG. 5, within interior region 108 may be disposed a plurality of wipes 110 that are interconnected such that pulling on a lead end of a lead wipe of the plurality of wipes causes a following wipe of the plurality of wipes to also be pulled and follow the lead wipe. Wipes 110 may be wound in the shape of a donut, as seen in FIG. 5. FIG. 5A shows donut of wipes 110 exploded from container body 102 and removable lid 100.

A container aperture 112 may be defined through an exterior wall of container 104. For example, container body 102 may be generally cylindrical in shape, with a hollow interior region 108. The bottom 114 of container body 102 may be closed, while the top 116 of container body 102 may be open, so as to define container aperture 112. A portion of container aperture 112 may be covered by removable lid 100.

Removable lid 100 may include a landing member 118 that may be formed from a rigid material. Rigid landing member 118 is part of lid 100, and covers a portion of container aperture 112 by extending from top rim 116 of container body 102 inwardly toward a middle (e.g., defined by a longitudinal axis A) of interior region 108 of container 104. Landing member 118 may include one or more features configured to enhance the ability of a user to pull wipes from container in a substantially vertical direction, while limiting any tendency of the interconnected wipes to "rope", to disengage from gripping channel 122 and fall back into container 104, or both. For example, as perhaps best seen in FIGS. 2D-2E, landing member 118 may form an angle with the substantially vertical exterior wall (e.g., wall 120) of container 108 that is less than 90°. In other words, landing member 118 may not be horizontal. For example, as illustrated in FIG. 2E, in an embodiment, an angle between landing member 118 and substantially vertical wall 120 may be from about 45° to 85°, from about 45° to 80°, or from about 65° to about 75°. (e.g., about 70°). Furthermore, as illustrated in FIGS. 1-3, landing member 118 may include a concave portion. For example, landing member 118 may be concavely curved, rather than generally planar, curving downward as landing member 118 extends from top rim 116 (FIG. 3) towards longitudinal axis A.

Such an angled or downwardly curved configuration advantageously decreases any tendency of the interconnected wipes to "rope" as they are pulled from wipes dispenser 106, through a gripping channel 122 in landing member 118, particularly where the wipes are pulled in a generally vertical orientation, as users are prone to do. For example, existing wipes containers often instruct the user to pull wipes at an angle (e.g., 45°) relative to vertical through a generally planar, horizontal landing member in an attempt to reduce roping. Users are prone to ignore such instructions, preferring instead to pull wipes out of such dispensers in a substantially vertical orientation. By providing a landing member 118 that is downwardly angled or concavely curved, a non-perpendicular angled relationship is advantageously provided between landing member 118 and the substantially vertical wipe as it is pulled, which angle aids in detaching the lead wipe from the following wipe as it is dispensed, reducing any roping tendency. Such an angle or concavely curved portion ensures increased frictional contact against the edges of gripping channel 122 as the wipe is pulled, aiding in separation of the lead wipe from a following wipe. Such a configuration may also aid in preventing fall back of the lead wipe through gripping channel 122 of landing member 118.

Container aperture 112 (FIG. 3) may reside in a substantially horizontal base plane. The angle between the horizontal base plane H of container aperture 112 and the direction at which the wipes are pulled from the container (i.e., a pull plane $P_1$) may be from about 70° and about 120°. For example, even if instructed otherwise, many consumers prefer to pull wipes at an angle of about 90° relative to the horizontal base plane, as seen in FIGS. 3 and 5. As described above, providing an angle between the direction of wipe pull (e.g., substantially vertical, perpendicular to container aperture 112) and the landing member, so that the given angle is not perpendicular (e.g., less than 90°) aids in preventing roping of the wipes as they are pulled from the dispenser. For example, the angle ($\theta_1$) formed between the horizontal base plane H and landing member 118 (e.g., at a point of entry through central aperture 125 (FIG. 2B) of gripping channel 122) may be from 5° to about 45°, from about 10° to about 45°, or from about 15° to about 25° as perhaps best seen in FIG. 2E.

Gripping channel 122 is perhaps best seen in FIG. 2B. Gripping channel 122 in landing member 118 communicates with interior 108 of container 104 through container aperture 112 such that individual wipes of the plurality of wipes are removed from container 104 by being pulled through gripping channel 122. Gripping channel 122 is configured to separate a lead wipe from a following wipe as the lead wipe is pulled through gripping channel 122. As illustrated in FIGS. 1-3, gripping channel 122 may be star or flower shaped, including a plurality of arms or petals 124. For example, the illustrated embodiment includes 6 petals surrounding a central aperture 125 through which a lead wipe may be pulled. As illustrated, the arms or petals 124 may include a narrower, constricted portion between the central aperture 125 of the gripping channel and the end of the respective arm or petal 124. Such a plurality of arms or petals 124 may further serve to separate the lead wipe from a following wipe, particularly where the wipe may be "pinched" by a constricted portion of each arm or petal 124.

Gripping channel 122 may be in communication with an outer edge 126 of landing member 118, including a threading portion 128 between outer edge 126 and the central aperture 125 of channel 122, which allows a user to thread a lead wipe into the central aperture 125 through threading portion 128. As shown, the entrance 130 into threading portion 128 at outer edge 126 may be funnel shaped, including a wider dimension at entrance 130, which narrows towards threading portion 128. In addition, as shown, threading portion 128 may be zig-zag shaped or include a curve, which may aid in preventing back-out of a lead wipe that is already engaged within central aperture 125 of gripping channel 122.

Where threading portion 128 is provided in landing member 118, a plurality of fingers 132 may be defined (e.g., on either side of entrance 130 and threading portion 128). Such fingers may extend towards the middle of interior region 108 and longitudinal axis A. For example, fingers 132 may define the furthest extension of landing member 118 towards longitudinal axis A. To further aid in easy threading of a lead wipe through entrance 130, into threading portion 128, and eventually into central channel 125 of gripping channel 122, fingers 132 may be oppositely curved or angled relative to adjacent portions of landing member 118, forming an upwardly directed re-curved or re-angled portion. Such a feature is perhaps best seen in FIGS. 1, 2A, and 2E.

To further aid in preventing roping of a following wipe as a lead wipe is dispensed, gripping channel 122 may be off-set from a center point (e.g., axis A) of container 104. Similarly, gripping channel 122 may be off-set from a center point of container aperture 112. In the embodiment illustrated in FIGS. 1-3, the center point of aperture 112 and container 104 may be the same, represented by longitudinal axis A, although it will be appreciated that other configurations are possible. For example, container 104 is illustrated as cylindrical, although this is not required, as various rectangular box-like configurations are certainly also possible. Off-setting of the gripping channel advantageously allows the wipes to enter gripping channel 122 from below at an angle (i.e., as opposed to entering vertically, with the center of the donut aligned with gripping channel 122), which further serves to ensure that the lead wipe separates from the following wipe as the lead wipe is pulled through gripping channel 122. This angled entry into gripping channel 122 is perhaps best seen in FIG. 5.

This causes the path of the wipe as it is dispensed from donut 110 into gripping channel 122 to be other than a simple vertical path, so that the wipe is pulled into gripping channel 122 at an angle as a result of the off-set. This other than simple vertical path creates increased engagement between the lead wipe and the edges of gripping channel 122, facilitating separation of the lead wipe from the following wipe. Once the lead end of the lead wipe passes through gripping channel 122 the lead end of the lead wipe is pulled vertically, also resulting in engagement between the edges of gripping channel 122 and the lead wipe, because of the concave or downwardly angled orientation of landing member 118 in the region of gripping channel 122. Such engagement ensures efficient separation of the lead wipe from a following wipe as the wipes are dispensed.

Removable lid 100 further includes a secondary aperture 134 through landing member 118, which allows a user to easily reach into container 104 and grab a lead wipe, and thread it through gripping channel 122. Secondary aperture may advantageously be relatively large relative to the size of landing member 118, occupying a significant fraction of container aperture 112. For example, as seen in FIG. 2B, container aperture 112 may have a diameter that is approximately equal to the diameter of removable lid 100, corresponding to circle $C_1$. Secondary aperture 134 defined through landing member 118 may include a portion opposite gripping channel 122 bounded by a radius associated with a circle $C_2$. Circle $C_2$ may have a size that is about 50% to about 95%, 60% to about 85%, or about 70% to about 80% that of circle $C_1$. For example, circle $C_2$ may have a radius that is about 75% that of $C_1$. Such a relatively large circle $C_2$ allows for a secondary aperture 134 that is relatively large, allowing a user to easily insert their fingers or hand to retrieve a lead wipe for threading into gripping channel 122. As shown, landing member 118 may extend inwardly over portion 136 opposite gripping channel 122, covering a relatively small portion of container aperture 112, if at all, preserving a wide secondary aperture 134 that will easily accommodate a user's inserted fingers and/or hand so as to grab a lead wipe. As shown, the portion 138 of landing member 118 opposite portion 136 (i.e., adjacent gripping channel 122 and fingers 132) may extend to a greater extent over container aperture 112, towards axis A, but still preserve a sufficiently large space so that a user's hands and/or fingers may be easily inserted into secondary aperture 134 without undue scraping and/or interference from portions 136 and 138 of landing member 118. For example, portion 138 of landing member 118 may cover less than 50%, less than 40%, or less than about 30% of circle $C_2$. For example, fingers 132 may extend no more than about 75%, no more than about 65%, no more than about 60%, or no more than about 50% of the distance from the edge of circle $C_2$ towards longitudinal axis A. This preserves a majority of the area of circle $C_2$ as the secondary aperture 134, allowing a user to insert fingers or a hand therein so as to retrieve a lead wipe, without fear of scraping the user's fingers or hand on the edges of secondary aperture 134.

Figure 3A:
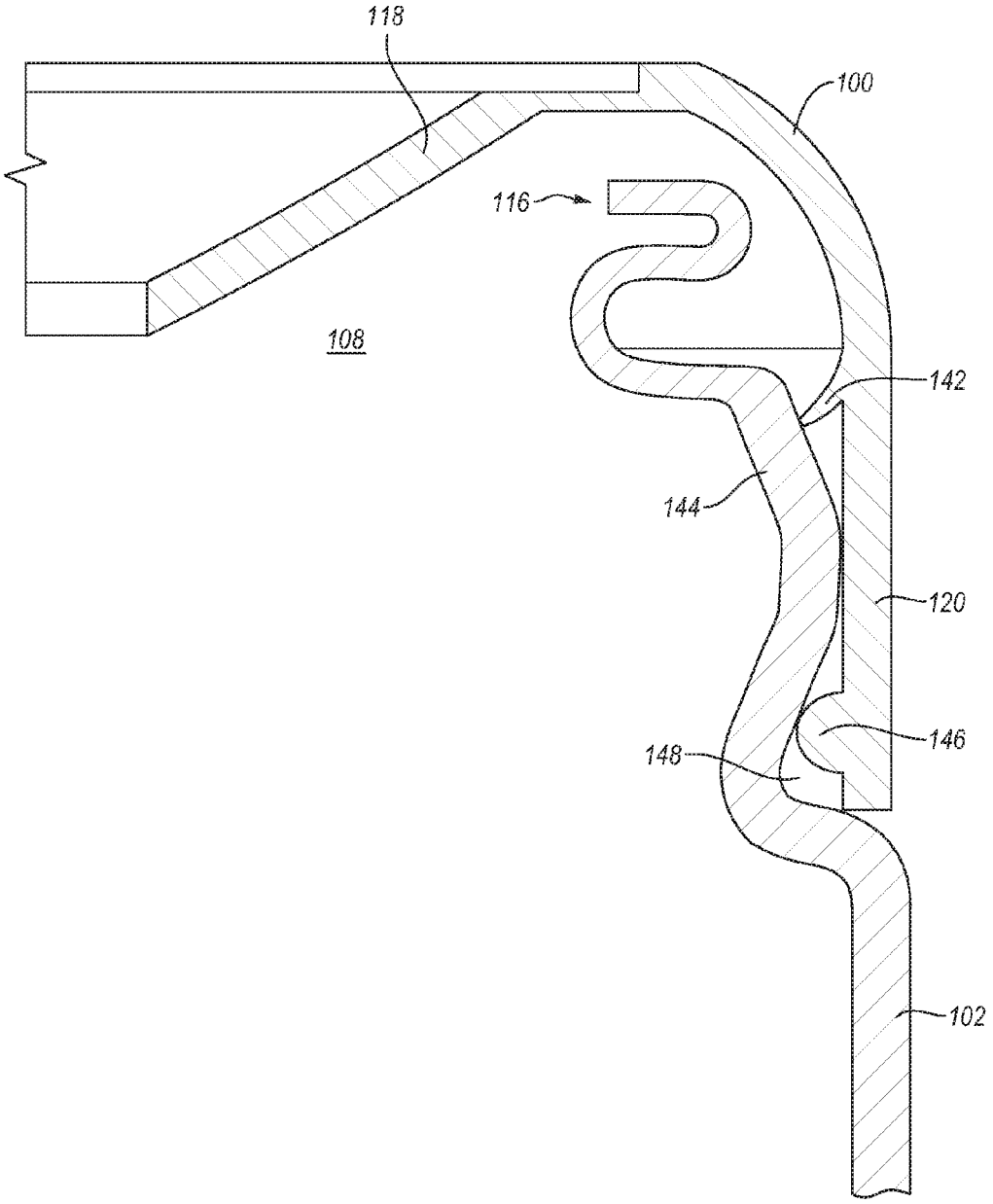
FIG. 3A is a cross-sectional view through the removable lid and container body of FIG. 3, illustrating an exemplary crab claw scaling member.

FIG. 3A shows a cross-sectional view along upper rim 116 of container body 102, as container body 102 engages with removable lid 100. In an embodiment, removable lid 100 may include a crab claw sealing member 142 which bends as it contacts side rim 144 of container body 102 as lid 100 is secured to container body 102. Such a crab claw sealing member aids in ensuring that internal region 108 is properly sealed so as to prevent the donut of wipes disposed in internal region 108 from prematurely drying out. In the illustrated embodiment, crab claw sealing member 142 may extend inwardly, towards the middle of container 104 from vertical sidewall 120 of removable lid 100. Crab claw sealing member 142 may extend from sidewall 120 at a downward angle of less than 90°, for example, from about 30° to about 70°, or from about 40° to about 60°. Such an angle orients crab claw sealing member 142 relative to side rim 144 so that crab claw sealing member 142 is deflected on contact with side rim 144, providing a seal therebetween.

Removable lid 100 may couple over top rim 116 of container body 102 by any suitable mechanism. As shown in FIG. 3A, removable lid 100 may include an annular ring 146 configured to be received within a corresponding annular groove 148 of container body 102. Such a mechanism may allow a user to simply press removable lid 100 over top 116 of container body 102. When ring 146 clicks into place in groove 148, the lid and container body are retained together. Removal of lid 100 may be achieved by simply pulling lid 100 off. In other embodiments, alternative coupling mechanisms (e.g., threads, mating grooves, etc.) may be provided.

Figure 4:
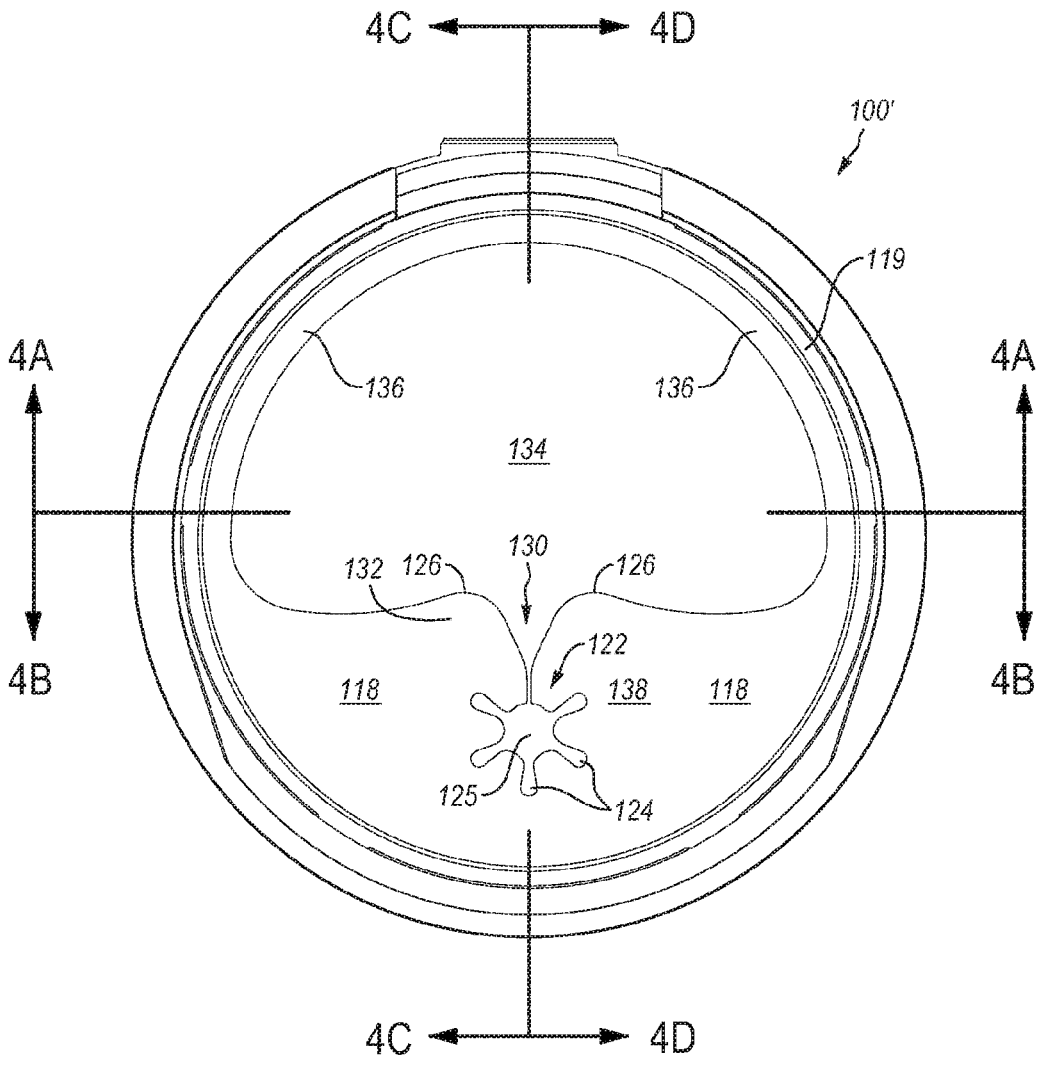
FIG. 4 is a top plan view of another removable lid.
Figure 4A:
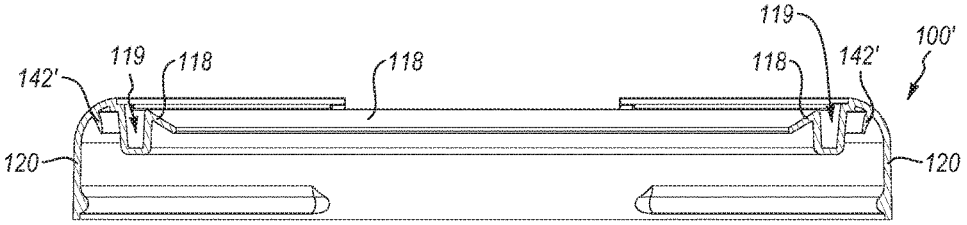
FIGS. 4A-4C show various cross-sectional views through the removable lid of FIG. 4.
Figure 4B:
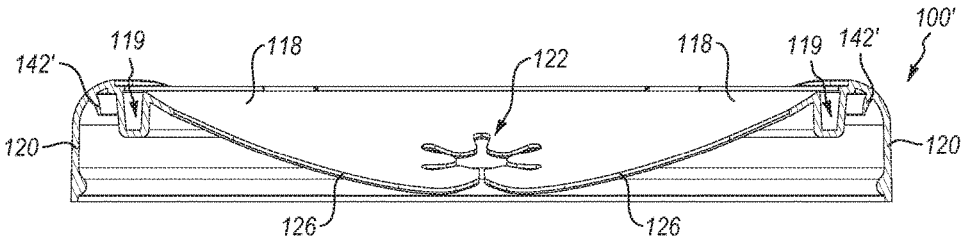
Figure 4C:
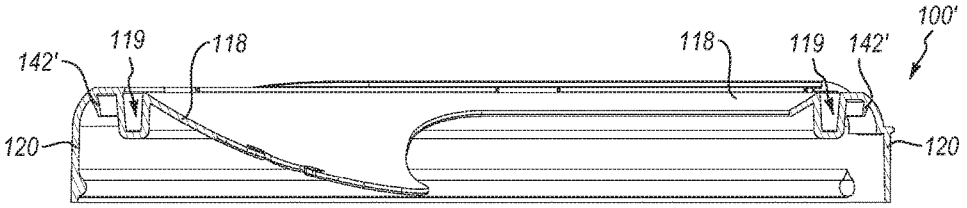
Figure 4D:
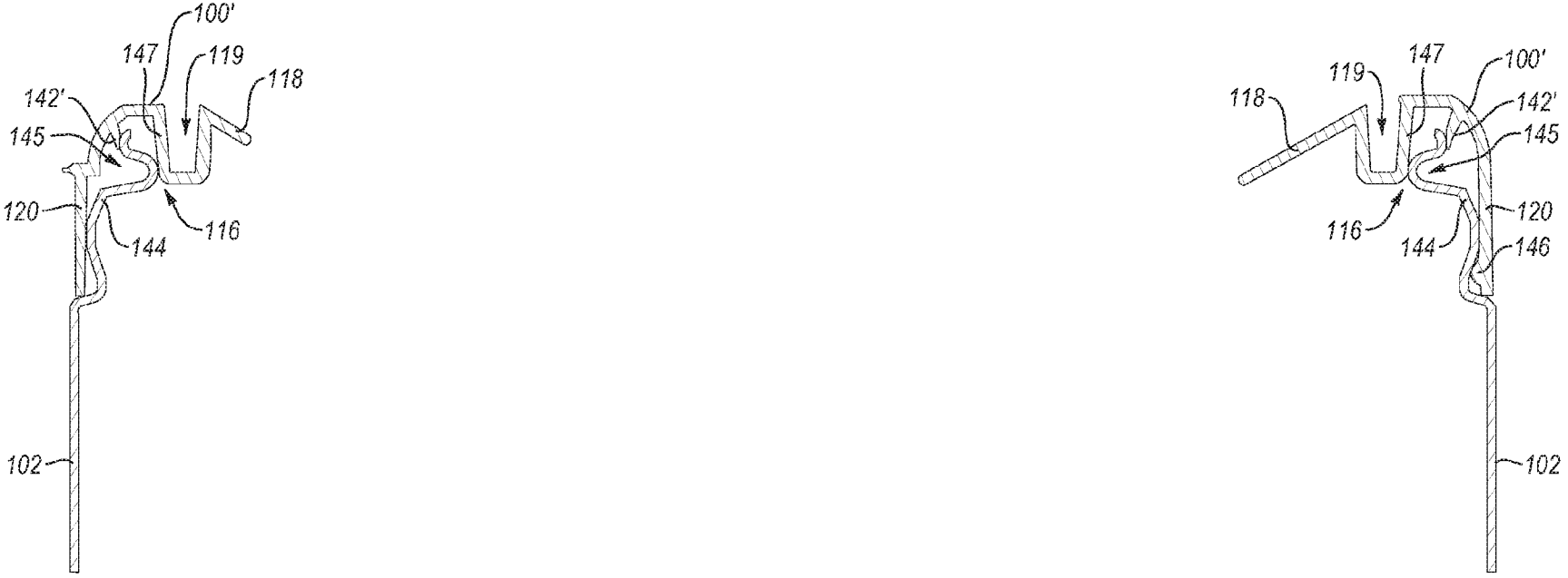
FIG. 4D shows a cross-sectional view through a removable lid and container, illustrating a somewhat differently configured sealing arrangement as compared to FIG. 3A.

FIGS. 4-4E illustrate somewhat differently configured removable lids. For example, FIGS. 4-4D illustrate an embodiment similar to that of FIGS. 1-3A, but in which the sealing arrangement by which the removable lid provides a plug or seal to seal the container body are somewhat different. For example, lid 100' shown in FIG. 4 and the cross-sections shown in FIGS. 4A-4C are similar to lid 100 shown in FIGS. 2B and 2C-2E, respectively. Principal differences include a differently configured entrance 130, providing direct access into aperture 125, rather than the zig-zag threading portion, the inclusion of an annular groove 119 at the periphery of landing member 118, and a somewhat differently configured sealing mechanism including crab claw 142'. As perhaps best seen in FIG. 4D, crab claw 142' may press and seal against the uppermost curve in the S-shaped curved top portion 145 of container body 102. In addition, S-shaped curved portion 145 at top 116 of container body 102 may be sandwiched between crab claw 142 and the outer wall 147 defining groove 119 (FIG. 4D). Sealing contact by both crab claw 142' and the outer wall 147 provides an excellent seal for the interior of container body 102, within which the wipes are stored, preventing the wipes from drying out. In such an embodiment, crab claw 142' may be referred to as a top claw, as it is disposed at or near the top of removable lid 100', and may seal against the top or last curve at top 116 of container body 102.

FIG. 4E shows a similar embodiment 100", but which may be referred to as including a side claw, as the crab claw 142" seals against the top portion of side rim 144, similar to the embodiment seen in FIG. 3A. As in FIG. 4D, sealing contact may be provided between the S-curve portion 145 at the top 116 of container body 102 and outer wall 147 of groove 119, again providing two points of contact for improved sealing.

Although FIGS. 1-5 illustrate a gripping channel 122 including a flower shaped portion with petals 124, it will be appreciated that variously other shaped gripping channels may be employed. FIGS. 6A-6M illustrate several various alternative gripping channels 122. It will readily be apparent to one of skill in the art that gripping channels having shapes other than those shown herein may also be employed.

FIGS. 7A-7E illustrate another removable lid 200 that may be used with a container body (e.g., container body 102 of FIG. 5). Such a removable lid and container body may form a wipes dispenser 106' from which a donut of wipes 110 may be dispensed. As other embodiments described herein, removable lid 200 may include a hinged cover 240 (FIGS. 7A-7B), which closes over landing member 218. It will be apparent that the illustrated embodiment of removable lid 200 may not include a secondary aperture (e.g., analogous to secondary aperture 134 of FIGS. 1-3), but may be configured such that landing member 218 covers most, or substantially all of the container aperture 112, but for gripping channel 222. In other embodiments, a secondary aperture such as described in other embodiments may be provided. Landing member 218 of removable lid 200 may be formed from a rigid material, and may cover nearly the entire open top (e.g., aperture 112 of FIG. 3) of the container body that the lid 200 may be coupled over. For example, landing member 218 may cover at least 50%, at least 60%, at least 70%, at least 80%, at least 90%, or at least 95% of the aperture of the container body when lid 200 is coupled over the container body.

Figure 7A:
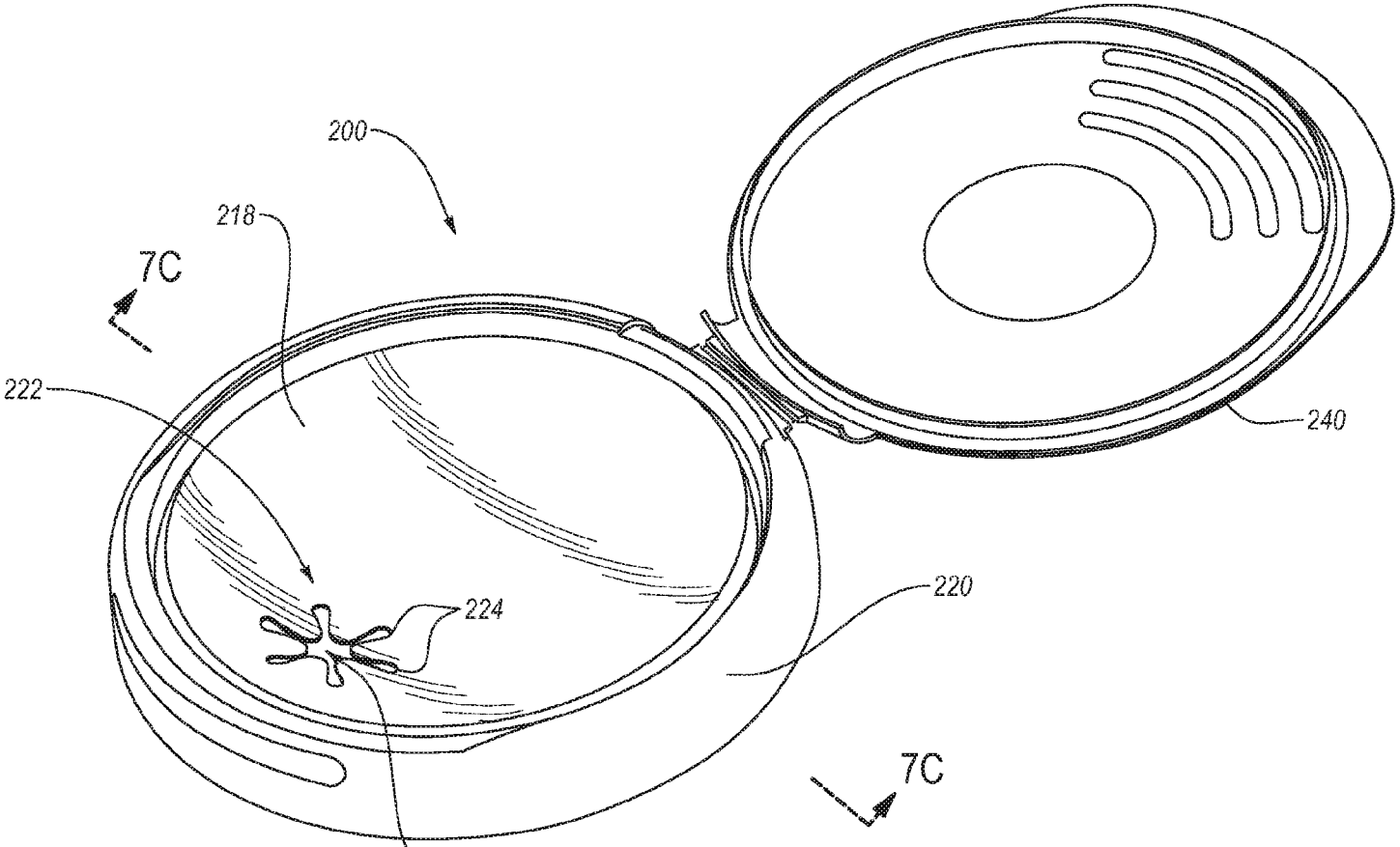
FIG. 7A is a top perspective view of another removable lid that may be coupled over a container body.
Figure 7B:
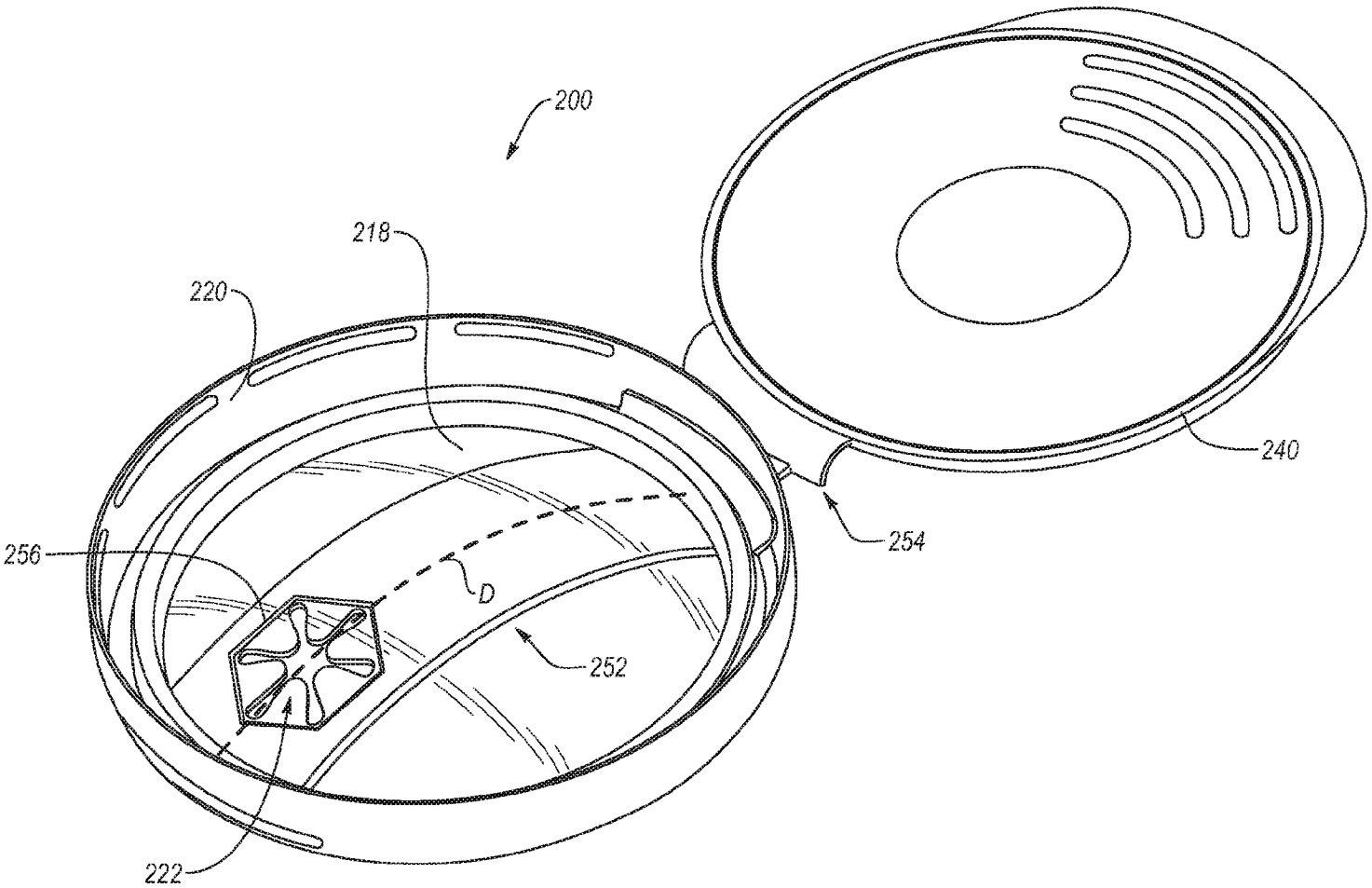
FIG. 7B is a bottom perspective view of the removable lid of FIG. 7A.
Figure 7C:
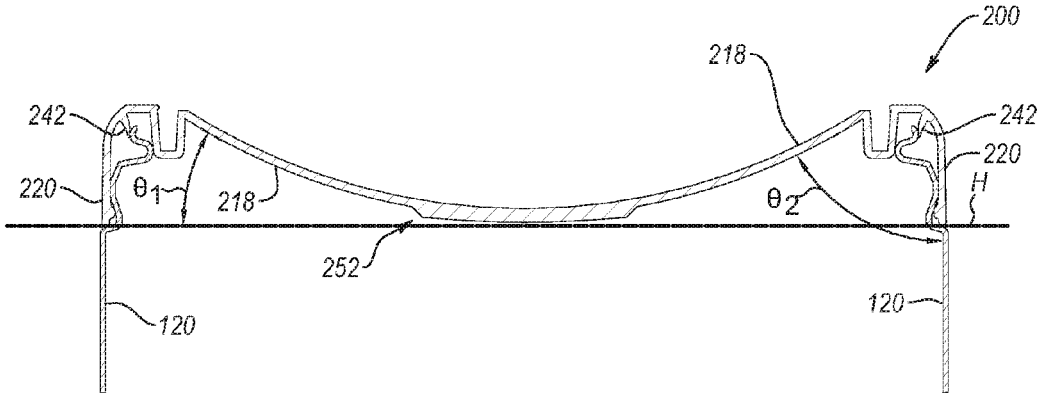
FIG. 7C is a cross-sectional view through the removable lid of FIG. 7B.

While landing member 218 may not include the large secondary aperture 134 shown in other removable lid embodiments described herein, it may still include one or more features configured to enhance the ability of a user to pull wipes from container in a substantially vertical direction, while limiting any tendency of the interconnected wipes to "rope", and/or to disengage from gripping channel 222 and fall back into the container. For example, as described with other embodiments, landing member 218 may form an angle ($\theta_2$) with the substantially vertical exterior wall 120 of a cylindrical container (e.g., 102) which it is coupled over or the sidewall of lid 200 that is less than 90°. A similar angle $\theta_2$ may be referenced between landing member 218 and sidewall 220 of lid 200 (e.g., where both walls 120 and 220 are substantially vertical). Such is apparent in FIG. 7C. An angle between landing member 218 and any such substantially vertical wall (or wall 220) may be from about 45° to 85°, from about 45° to 80°, or from about 65° to about 75° (e.g., about 70°). Similar to embodiments described above, the angle ($\theta_1$) formed between the horizontal base plane H and landing member 218 may be from 5° to about 45°, from about 10° to about 45°, or from about 15° to about 25° as seen in FIG. 7C. As illustrated in FIGS. 7A-7C, landing member 218 may be concavely curved along its top surface, and convexly curved along the bottom surface.

Figure 7D:
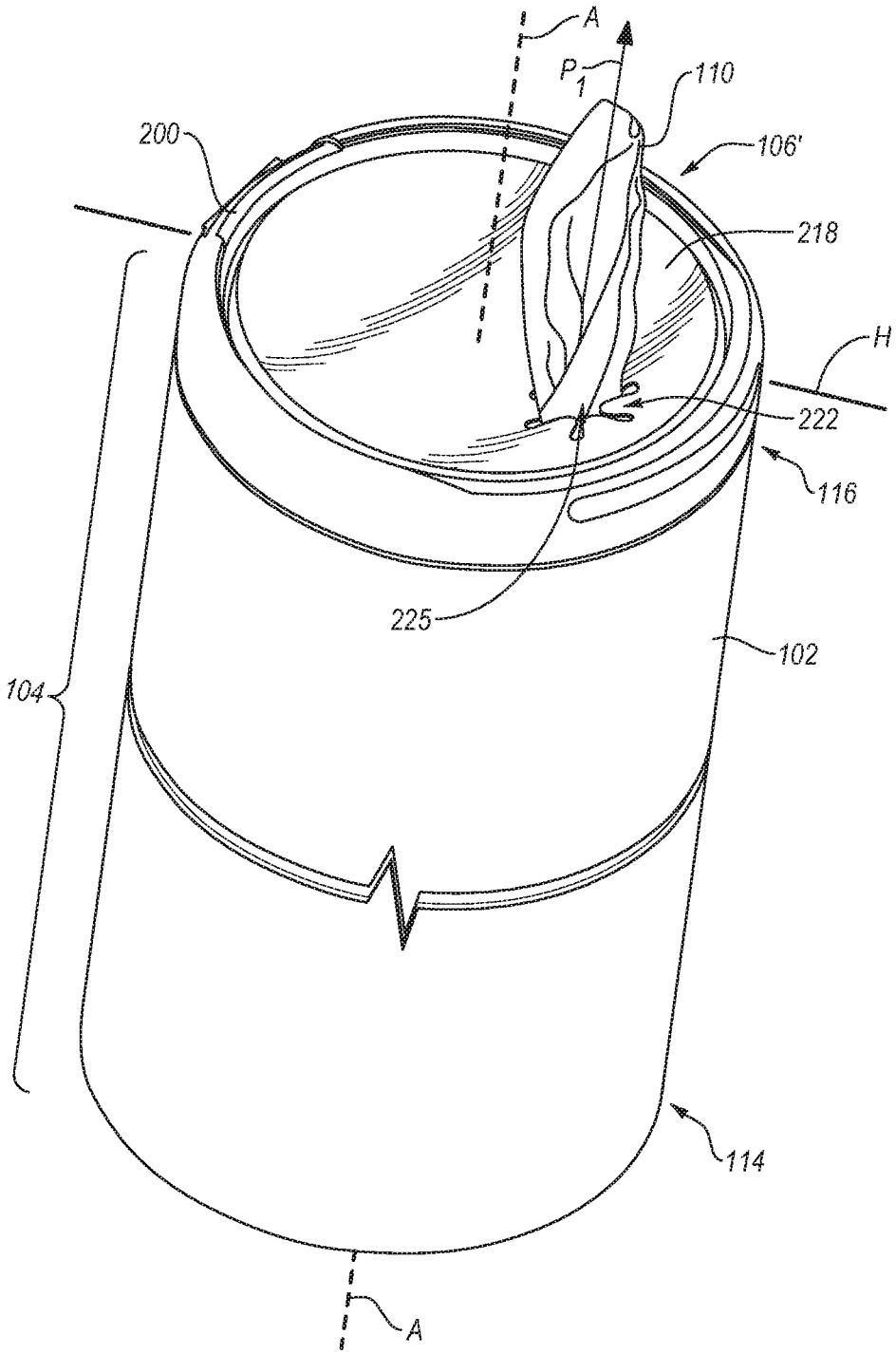
FIG. 7D is a perspective view of an exemplary wipes dispenser similar to that of FIG. 5, but shown with the removable lid of FIGS. 7A-7C.
Figure 7E:
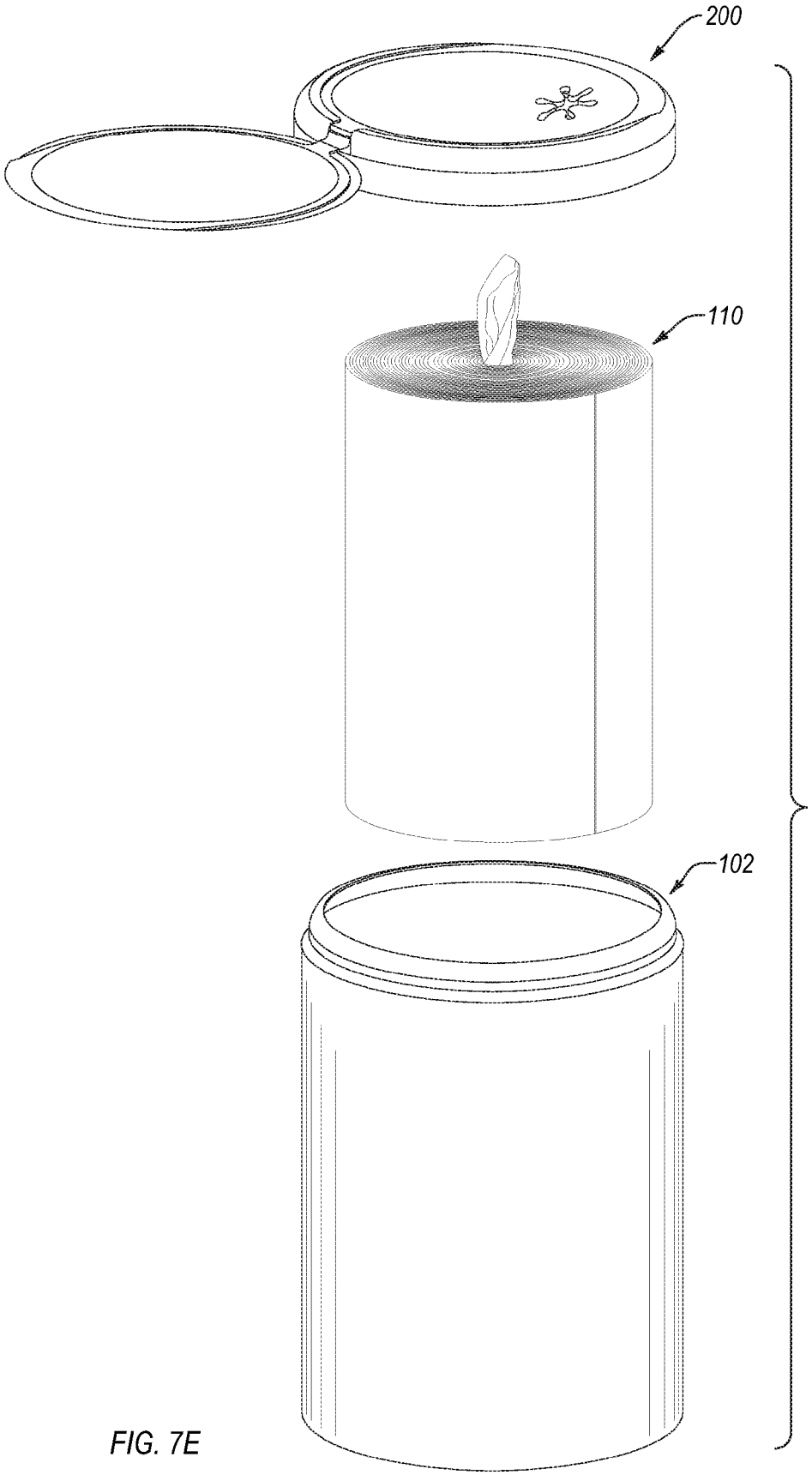
FIG. 7E is an exploded view of the exemplary wipes dispenser of FIG. 7D.

Gripping channel 222 may communicate with an interior of the container, and may be star or flower shaped, including a plurality of arms or petals 224, similar to channel 222 of FIGS. 1-3. Another notable difference of gripping channel 222 is that it is shown as including a closed perimeter, e.g., it is not connected to any secondary aperture. For example, the gripping channel 122 of FIGS. 1-3 is connected to secondary aperture 134 by threading portion 128. Based on this different configuration, it will be apparent that the user may thread the lead wipe through central aperture 225 of gripping channel 222, as seen in FIG. 7D. FIG. 7E shows container body 102 exploded from removable lid 200, with donut of wipes 110 shown therebetween.

To further aid in preventing roping of a following wipe as a lead wipe is dispensed, gripping channel 222 may be off-set from a center point (e.g., axis A) of the lid 200 and an underlying container. As described above, off-setting of the gripping channel advantageously allows the wipes to enter gripping channel 222 from below at an angle (i.e., as opposed to entering vertically, with the center of the donut aligned with gripping channel 222), which further serves to ensure that the lead wipe separates from the following wipe as the lead wipe is pulled through gripping channel 222.

Similar to other embodiments described herein, removable lid 200 may couple over a top rim of container body 102 by any suitable mechanism. FIGS. 7B-7C shows how a strip or other shaped region 252 of thickened material may be provided along at least a portion of landing member 218. For example, as illustrated, strip 252 may surround at least a portion, or the entirety of gripping channel 222. As described in further detail below, strip 252 may be at least as wide, or wider than impression artifact or "witness" 256. Thickened strip 252 may be at least about 1%, at least about 3%, at least about 5%, at least about 10%, from about 5% to about 200%, from about 10% to about 100%, or from about 25% to about 100% thicker than the immediately adjacent region of landing member 218, which is not thickened. FIG. 7B shows how thickened strip 252 is wider than impression artifact or "witness" 256, so that strip 252 fully surrounds such an artifact or "witness". It will be appreciated that the remainder of landing member 218 may be substantially equal in thickness across its area, other than strip 252.

Strip 252 is shown extending across the landing member 218 in a manner such that strip 252 is centered with the diameter D of landing member 218. Furthermore, as perhaps best illustrated in FIG. 7B, strip 252 may be aligned with hinge 254 which hingedly attaches cover 240 to the remainder of lid 200. Furthermore, it will be apparent from FIGS. 7A-7C that the increased thickness of strip 252 may be disposed on the underside of landing member 218, so that the entire top surface of landing member 218 may be flush across its entire surface (except for where channel 222 is formed therethrough), including where strip 252 is formed thereunder. On the bottom side, the strip or region 252 may thus project or "jut out" from the adjacent un-thickened areas of landing member 218. Such a configuration hides the thickened region 252 during typical use (e.g., see FIG. 7D).

Thickened strip or other region 252 may provide increased strength and rigidity in the region surrounding channel 222, as shown. For example, the lid 200 may be injection molded, after which channel 222 may be stamped or die cut through landing 218, as shown. As shown in FIG. 7B, such stamping or die cutting may result in an impression artifact or "witness" 256 surrounding the gripping channel 222, having geometry and size corresponding to the slug used to create gripping channel 222. FIG. 7B shows the impression artifact as hexagonal shaped (e.g., where a hexagonal shaped die or punch is used), although it will be appreciated that any other shape to impression artifact may result, depending on the geometry of the employed stamping or die cutting tooling used. The thickened strip or region 252 may be sufficiently wide to ensure that the impression artifact 256 is entirely within the bounds of thickened strip or region 252. Such a thickened strip or region aids in ensuring that the landing member has sufficient strength and rigidity to form the channel 222 therein through a typical high volume automated production process (e.g., stamping or die cutting), without damaging surrounding regions of the landing member 218.

For example, impression artifact 256 may recess into thickened region 252. The amount of such recessing may be such that the thickness of landing member 218 within impression artifact 256 is still at least as thick as the un-thickened portions of landing member 218, outside of thickened strip 252. Such a thickened strip or region 252 thus helps to ensure that when stamping, die cutting or otherwise forming gripping channel 222, the strength and thickness of the material surrounding such channel is not unduly compromised.

Removable lid 200 may include any feature described in the previous embodiments. By way of example, a crab claw sealing member 242 which bends as it contacts a side rim of container body 102 as lid 200 is secured to container body 102 may be provided in lid 200, as shown in FIG. 7C.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A wipes dispenser comprising:

(a) a container comprising a container body and a removable lid forming an interior region containing a plurality of wipes that are interconnected such that pulling on a lead end of a lead wipe of said plurality of wipes causes a following wipe of said plurality of wipes to also be pulled and follow said lead wipe;

(b) a crab claw sealing member provided on said removable lid which bends as it contacts a side rim of said container body when the lid is secured to said container body; and (c) a container aperture defined through an exterior wall of said container;

(d) a rigid landing member which is part of said lid, the landing member has a concave portion which covers an entirety of said container aperture by extending from a top rim of said container body toward the middle of the interior region of said container, but for a gripping channel formed through the landing member;

(e) the gripping channel in said landing member communicating with the interior of the container through said container aperture, and wherein said plurality of wipes are removed from said container by being pulled through said gripping channel, said gripping channel separating a lead wipe from a following wipe as said lead wipe is pulled through said gripping channel; and (f) a thickened strip of material extending across a concavely curved bottom surface of the landing member and surrounding at least a portion of the gripping channel, the thickened strip of material being about 25 to 100% thicker than adjacent portions of the landing member.

2. The wipes dispenser of claim 1, wherein said thickened strip of material is aligned with a diameter of the landing member.

3. The wipes dispenser of claim 1, wherein said thickened strip of material surrounds the entire gripping channel.

4. The wipes dispenser of claim 1, wherein a top surface of the landing member is flush across substantially its entire top surface, including the thickened strip of material, and wherein said thickened strip of material projects beyond adjacent portions of the landing member along a bottom surface of the landing member.

* * * * *